US010619925B2

(12) United States Patent
Kamiya

(10) Patent No.: US 10,619,925 B2
(45) Date of Patent: Apr. 14, 2020

(54) HEATING DEVICE FOR HOT STAMPING

(71) Applicant: FUTABA INDUSTRIAL CO., LTD., Okazaki-shi, Aichi (JP)

(72) Inventor: Yoshihiro Kamiya, Okazaki (JP)

(73) Assignee: FUTABA INDUSTRIAL CO., LTD., Okazaki-Shi, Aichi (JP)

( * ) Notice: Subject to any disclaimer, the term of this patent is extended or adjusted under 35 U.S.C. 154(b) by 0 days.

(21) Appl. No.: 15/953,775

(22) Filed: Apr. 16, 2018

(65) Prior Publication Data

US 2018/0231313 A1 Aug. 16, 2018

Related U.S. Application Data

(62) Division of application No. 14/759,771, filed as application No. PCT/JP2013/084861 on Dec. 26, 2013, now abandoned.

(30) Foreign Application Priority Data

Jan. 11, 2013 (JP) ..... 2013-003723

(51) Int. Cl.
*F27B 9/36* (2006.01)
*C21D 9/00* (2006.01)
(Continued)

(52) U.S. Cl.
CPC ..... *F27B 9/36* (2013.01); *C21D 1/18* (2013.01); *C21D 9/0006* (2013.01);
(Continued)

(58) Field of Classification Search
CPC ..... B21D 22/022; B21D 22/208; C21D 1/18; C21D 1/673; C21D 9/0006; C21D 9/0056; C21D 9/46; F27B 9/2407; F27B 9/36
(Continued)

(56) References Cited

U.S. PATENT DOCUMENTS 6,613,165 B1 9/2003 Alexander
7,540,993 B2 * 6/2009 Reinhold ..... C21D 9/0006 148/579
(Continued)

FOREIGN PATENT DOCUMENTS

CA 2807332 A1 3/2012
EP 2767599 A1 8/2014
(Continued)

OTHER PUBLICATIONS

Office Action for Canadian Patent Application No. 2,897,287 dated Jun. 13, 2016, 4 pages.
(Continued)

*Primary Examiner* — Scott R Kastler
*Assistant Examiner* — Michael Aboagye
(74) *Attorney, Agent, or Firm* — Withrow & Terranove, P.L.L.C.; Vincent K. Gustafson

(57) ABSTRACT

A method of heating for hot stamping is configured to heat a plated metallic material while conveying the plated metallic material. A heating device for hot stamping comprises: a first heating tank provided in a conveyance path for the plated metallic material; and a second heating tank provided downstream of the first heating tank in the conveyance path. A heating amount provided by the second heating tank is configured such that a temperature of the plated metallic material becomes equal to or higher than Ac3 point and less than a boiling point of a plating of the plated metallic material, and a heating amount provided by the first heating tank is configured to be larger than the heating amount provided by the second heating tank.

9 Claims, 4 Drawing Sheets

(51) Int. Cl.

| | |
|---|---|
| ***F27B 9/24*** | (2006.01) |
| ***C21D 1/18*** | (2006.01) |
| ***B21D 22/02*** | (2006.01) |
| ***C21D 9/46*** | (2006.01) |
| ***B21D 22/20*** | (2006.01) |
| ***C21D 1/673*** | (2006.01) |

(52) U.S. Cl.
CPC ..... *C21D 9/0056* (2013.01); *F27B 9/2407* (2013.01); *B21D 22/022* (2013.01); *B21D 22/208* (2013.01); *C21D 1/673* (2013.01); *C21D 9/46* (2013.01)

(58) Field of Classification Search
USPC ..... 266/249, 252; 72/47, 57, 60; 148/511, 148/564
See application file for complete search history.

(56) References Cited

U.S. PATENT DOCUMENTS

| | | | | |
|---|---|---|---|---|
| 9,138,797 | B2 * | 9/2015 | Samek ..... | B21D 22/02 |
| 2008/0296283 | A1 | 12/2008 | Melgaard et al. | |
| 2009/0320968 | A1 | 12/2009 | Boeke et al. | |
| 2010/0300584 | A1 | 12/2010 | Buschsieweke et al. | |
| 2011/0042369 | A1 | 2/2011 | Ishiguro et al. | |
| 2012/0073351 | A1 | 3/2012 | Maki et al. | |
| 2012/0091758 | A1 | 4/2012 | Zimmermann et al. | |
| 2013/0118646 | A1 | 5/2013 | Kobayashi et al. | |
| 2014/0224388 | A1 | 8/2014 | Frost et al. | |
| 2015/0352621 | A1 | 12/2015 | Kamiya | |
| 2016/0060735 | A1 | 3/2016 | Maki et al. | |

FOREIGN PATENT DOCUMENTS

| | | | |
|---|---|---|---|
| JP | 11-256235 | A | 9/1999 |
| JP | 11-316085 | A | 11/1999 |
| JP | 2009176584 | A | 8/2009 |
| WO | 2012026442 | A1 | 3/2012 |
| WO | 2014171417 | A1 | 10/2014 |

OTHER PUBLICATIONS

Extended European Search Report for European Patent Application No. 13871152.8 dated Sep. 22, 2016 (8 pages).
Notice of Reason(s) for Rejection for Japanese Patent Application No. 2014-556380 dated Jun. 28, 2016, (6 pages including English translation).
International Search Report for International Application No. PCT/JP2013/084861 (Form PCT/ISA/210), dated Mar. 18, 2014, 1 page.
English Translation of International Preliminary Report on Patentability for International Application No. PCT/JP2013/084861 (Form PCT/IPEA/409), dated Jul. 11, 2015, 5 pages.
Notification of Transmittal of Translation of the International Preliminary Report on Patentability for International Application No. PCT/JP2013/084861 (Form PCT/IB/338), dated Jul. 16, 2015, 1 page.
Partial English Translation of Written Opinion of the International Search Authority for International Application No. PCT/JP2013/084861 (Form PCT/ISA/237), dated Jul. 11, 2015, 1 page.
Non-Final Office Action for U.S. Appl. No. 14/759,771, dated Jul. 12, 2017, 8 pages.
Final Office Action for U.S. Appl. No. 14/759,771, dated Jan. 17, 2018, 9 pages.

* cited by examiner

HEATING DEVICE FOR HOT STAMPING

CROSS-REFERENCE TO RELATED APPLICATIONS

This application is a divisional of U.S. patent application Ser. No. 14/759,771 filed Jul. 8, 2015, now abandoned, which is a 35 U.S.C. § 371 national phase filing of International Application No. PCT/JP2013/084861 filed Dec. 26, 2013, and claims the benefit of Japanese Patent Application No. 2013-3723 filed Jan. 11, 2013 in the Japan Patent Office. The entire disclosures of the foregoing applications are hereby incorporated by reference herein.

TECHNICAL FIELD

The present invention relates to a heating device for hot stamping.

BACKGROUND ART

Hot-stamp working (hot press working) has been known, in which a metallic material is heated to its hardening temperature, and the heated metallic material in a high-temperature state is worked. Patent Document 1 describes a heating device for hot stamping, which is used to heat an unprocessed metallic material.

PRIOR ART DOCUMENTS

Patent Documents

Patent Document 1: Japanese Unexamined Patent Application Publication No. 2009-176584

SUMMARY OF THE INVENTION

Problems to be Solved by the Invention

In a heating device for hot stamping, it is required to heat a metallic material to a high temperature state in a short period of time.

In one aspect of the present invention, it is desired that a metallic material is heated to a high temperature state in a short period of time.

Means for Solving the Problems

One aspect of the present invention is a heating device for hot stamping configured to heat a plated metallic material while conveying the plated metallic material. The heating device for hot stamping comprises a first heating tank provided in a conveyance path for the plated metallic material, and a second heating tank provided downstream of the first heating tank in the conveyance path; a heating amount provided by the second heating tank is configured such that a temperature of the plated metallic material becomes equal to or higher than Ac3 point and less than a boiling point of a plating of the plated metallic material; and a heating amount provided by the first heating tank is configured to be larger than the heating amount provided by the second heating tank. With this configuration, the metallic material can be heated to a high temperature state in a short period of time.

In the above-described heating device for hot stamping, the first heating tank may be designed such that a staying time of the plated metallic material is longer in the first heating tank than in the second heating tank. With this configuration, time required for heating the plated metallic material can be reduced, compared with a configuration in which the staying time of the plated metallic material is longer in the second heating tank than in the first heating tank.

In the above-described heating device for hot stamping, the first heating tank and the second heating tank may be formed in a continuous space and may use an infrared heater as a heat source. With this configuration, the plated metallic material is heated mainly by emitted heat (radiant heat). Therefore, compared with a configuration in which a gas burner, etc., is used as a heat-generating source (a configuration in which the plated metallic material is heated mainly by convection heating), a temperature distribution can be made clear in a continuous area between the first heating tank and the second heating tank. Consequently, variability in a temperature of the plated metallic material can be inhibited; therefore, for example, it is possible to design, with higher accuracy, the staying time, etc., of the plated metallic material in the first heating tank, and it is possible to downsize the overall heating tank.

EXPLANATION OF REFERENCE NUMERALS

1 . . . heating device, 2 . . . conveying device, 3 . . . infrared heater, 3A . . . upstream-side heater, 3B . . . downstream-side heater, 4 . . . carrying-in device, 5 . . . carrying-out device, 9 . . . metal plate, 31 . . . upstream-side heating tank, 32 . . . downstream-side heating tank.

MODE FOR CARRYING OUT THE INVENTION

Hereinafter, an embodiment to which the present invention is applied will be described with reference to the drawings.

Figure 1:
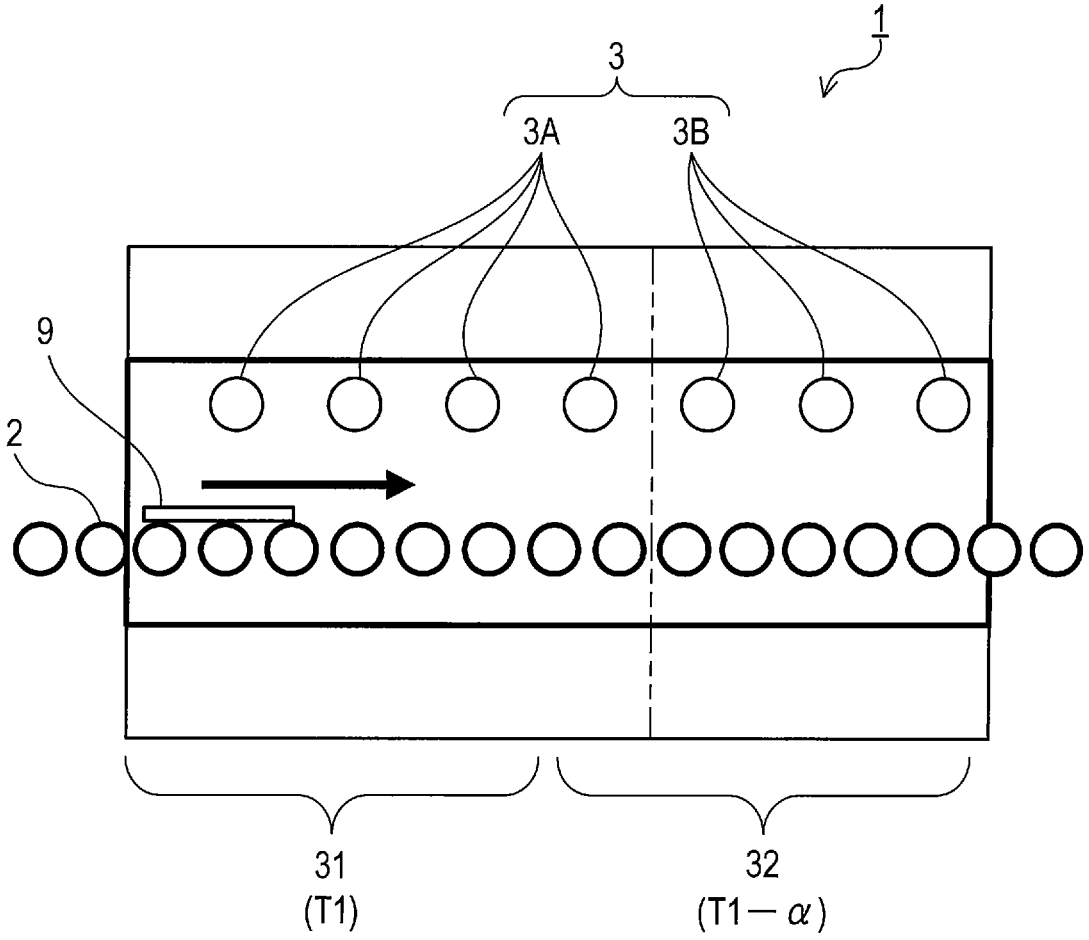
FIG. 1 is a diagram showing a configuration of a heating device of an embodiment.

A heating device 1 shown in FIG. 1 is configured to heat a metal plate (iron sheet) 9, which is an object to be processed (workpiece) by hot-stamping, up to its hardening temperature (for example, 900° C.) prior to the process. The heating device 1 comprises a conveying device 2 and an infrared heater 3. As the metal plate 9, a plated metallic material (in the present embodiment, a Zn-plated material) is used.

The conveying device 2 is configured to convey the metal plate 9 in a fixed direction (in the right direction in FIG. 1), in a conveyance path (continuous furnace) formed inside of the heating device 1; the conveying device 2 comprises, for example, a plurality of conveyance rollers that are rotary-driven in a constant direction.

The infrared heater 3 is disposed on a ceiling surface of the conveyance path, and the metal plate 9 that is conveyed below is heated by emitted heat (radiant heat) caused by heat generation of the infrared heater 3. That is, a heating tank with the infrared heater 3 as a heat-generating source is formed in the conveyance path for the metal plate 9.

The heating tank is broadly divided into an upstream-side heating tank 31, and a downstream-side heating tank 32 provided downstream of the upstream-side heating tank 31 in the conveyance path. The upstream-side heating tank 31 and the downstream-side heating tank 32 are formed in a continuous space. Here, the upstream-side heating tank 31 is configured to have a heating amount larger than that of the downstream-side heating tank 32. The "heating amount" used herein means an amount per unit time of heat that is to be applied to an object to be heated under a certain condition. If a heating condition is fixed, as a heat source temperature becomes higher, the heating amount becomes larger. Also, if the object to be heated is heated at an ambient temperature, as the ambient temperature becomes higher, the heating amount becomes larger. Specifically, the heating amount provided by the downstream-side heating tank 32 is configured such that a temperature of the metal plate 9 becomes equal to or higher than Ac3 point and less than a boiling point of the plating of the metal plate 9. The heating amount provided by the upstream-side heating tank 31 is configured to be larger than the heating amount provided by the downstream-side heating tank 32. Here, "Ac3 point" is a temperature at which the metal plate 9 is transformed to austenite due to heating.

Moreover, in order to inhibit the temperature of the metal plate 9 in the upstream-side heating tank 31 from increasing to be equal to or higher than the boiling point of the plating of the metal plate 9, a conveying distance and a conveying speed in the upstream-side heating tank 31 are configured such that the metal plate 9 can be conveyed to the downstream-side heating tank 32 during an increase of the temperature of the metal plate 9. On the other hand, compared with the downstream-side heating tank 32, the upstream-side heating tank 31 having the larger heat amount allows the temperature of the metal plate 9 to increase in a short period of time. Therefore, to the extent that the temperature of the metal plate 9 does not increase excessively, a staying time of the metal plate 9 in the upstream-side heating tank 31 is configured to be as long as possible. In the heating device 1 of the present embodiment, the staying time of the metal plate 9 is longer in the upstream-side heating tank 31 than in the downstream-side heating tank 32. Here, the staying time is adjustable by changing at least one of a length of the conveyance path and the conveying speed.

In the present embodiment, the infrared heater 3 in the upstream side (hereinafter referred to as "upstream-side heater 3A") is configured to have a high temperature in the conveyance path, compared with the infrared heater 3 disposed downstream of the upstream-side heater 3A (hereinafter referred to as "downstream-side heater 3B"). That is to say, in the present embodiment, the heating amount is adjusted by the heat source temperature. Accordingly, the volume of the heating amount mentioned in the above description can be understood as a value of the heat source temperature. For example, a target temperature of the metal plate 9 is T1−β (e.g., a temperature around the hardening temperature), while a set temperature of the upstream-side heater 3A (heat source temperature) is T1 (e.g., a temperature sufficiently higher than the hardening temperature) and a set temperature of the downstream-side heater 3B (heat source temperature) is T1−α (e.g., a temperature higher than the hardening temperature, for example, $\alpha<\beta$). In this manner, the continuous furnace is divided into first-half and second-half stages (controlled by zones) in the longitudinal direction. In the first-half stage, the temperature of the infrared heater 3 is configured to be significantly higher than the target temperature, so as to increase the temperature of the metal plate 9 in a short period of time. On the other hand, in the second-half stage, the temperature of the infrared heater 3 is configured to be around the target temperature, so as to uniform (stabilize) the temperature of the metal plate 9 to be the target temperature.

According to the above-described embodiment, the following effects can be obtained.

Figure 2:
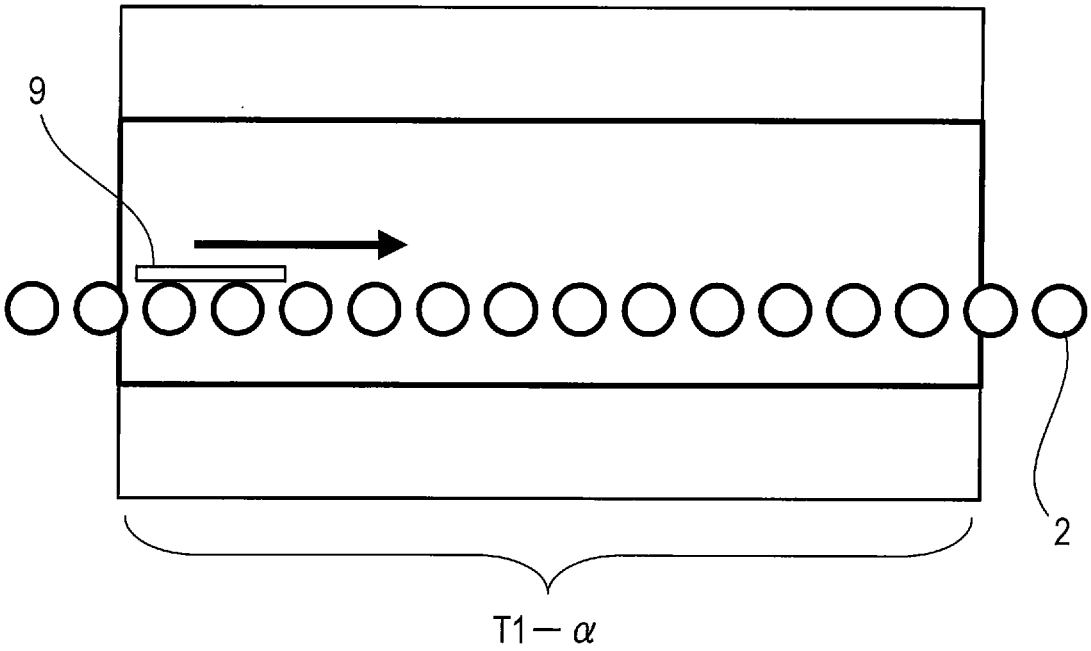
FIG. 2 is a diagram showing a configuration of a heating device of a comparative example.
Figure 3:
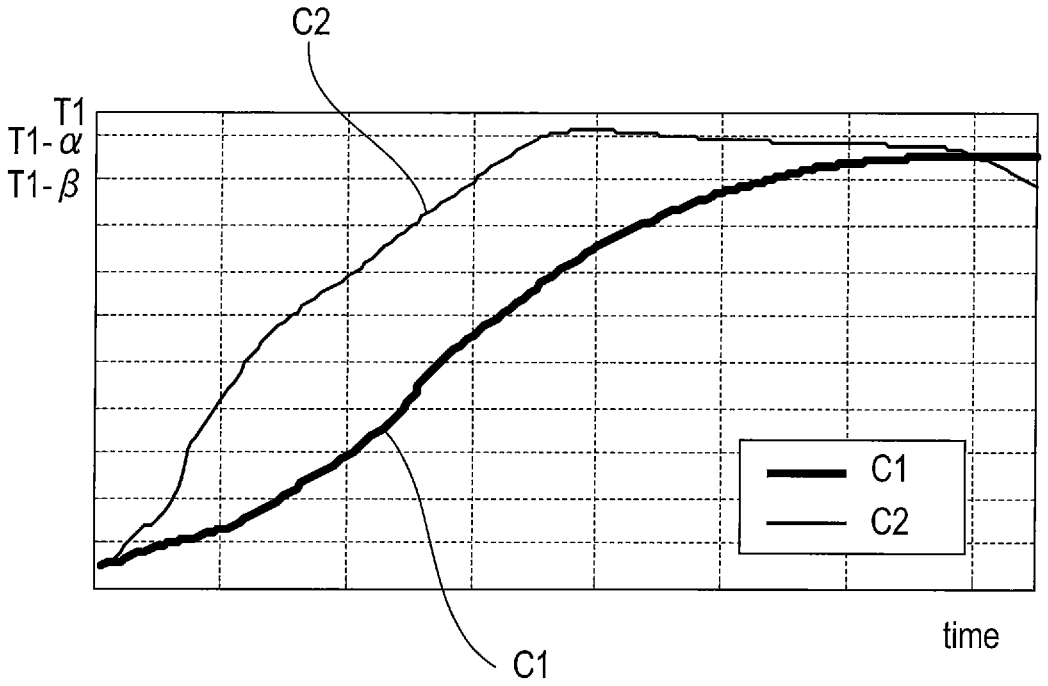
FIG. 3 is a graph showing relationships of time and temperature.

[A1] In the heating device 1, the heating amount provided by the downstream-side heating tank 32 is configured such that the temperature of the metal plate 9 becomes equal to or higher than Ac3 point and less than the boiling point of the plating of the metal plate 9. On the other hand, the heating amount provided by the upstream-side heating tank 31 is configured to be larger than the heating amount provided by the downstream-side heating tank 32. Therefore, for example, compared with a configuration in which heating is performed at a constant temperature (e.g., T1-α) as shown in FIG. 2, the present embodiment can heat the metal plate 9 to a desired high-temperature state (target temperature) in a short period of time, and thereafter, make the temperature uniform. Specifically, as shown in FIG. 3, compared with a heating method (C1) in which heating is performed at a constant temperature as in the configuration shown in FIG. 2, a heating method (C2) in which heating during the first half is performed at a high temperature as in the present embodiment causes a rapid temperature increase, and thus, the temperature reaches to the target temperature in a short period of time.

[A2] The staying time of the metal plate 9 is designed to be longer in the upstream-side heating tank 31 than in the downstream-side heating tank 32. Therefore, compared with a configuration in which the staying time of the metal plate 9 is longer in the downstream-side heating tank 32 than in the upstream-side heating tank 31, the present embodiment can reduce time required for heating the metal plate 9.

[A3] Because of use of the infrared heater 3, the metal plate 9 is heated mainly by emitted heat (radiant heat); therefore, for example, compared with heating by combustion of gas (convection heating), the heating amount can be easily varied, and higher heating efficiency can be achieved. In addition, a clear temperature distribution can be obtained in a contiguous area between the upstream-side heating tank 31 and the downstream-side heating tank 32. As a result, variability in the temperature of the metal plate 9 can be inhibited. Thus, for example, the staying time, etc. of the metal plate in the upstream-side heating tank 31 can be configured with higher accuracy, and the overall heating tank can be downsized.

Here, the heating device 1 corresponds to one example of a heating device for hot stamping, the upstream-side heating tank 31 corresponds to one example of a first heating tank, the downstream-side heating tank 32 corresponds to one example of a second heating tank, and the metal plate 9 corresponds to one example of a metallic material.

The embodiment of the present invention has been descried as above; however, needless to say, the present invention should not be limited to the aforementioned embodiment but can adopt various modes.

[B1] The aforementioned embodiment illustrates a configuration in which a heater with a heat source having a high temperature is used, so that the heating amount provided by the upstream-side heating tank 31 can be greater than the heating amount provided by the downstream-side heating tank 32. However, the present embodiment should not be limited to this configuration. For example, when the object to be heated is heated at an ambient temperature, the ambient temperature may be varied; this is because, as the ambient temperature becomes higher, the heating amount becomes greater. Moreover, for example, it may be configured such that a number (density) of the heater in the upstream-side heating tank 31 is greater than a number (density) of the heater in the downstream-side heating tank 32.

[B2] It may be configured such that the temperature of the metal plate 9 is detected, and depending on the detected temperature, at least one of a conveyance control and a temperature control is performed. For example, it may be controlled such that the temperature of the metal plate 9 is increased to a specified temperature (for example, 800° C.) in the first-half stage and then, the metal plate 9 is conveyed to the second-half stage.

Figure 4:
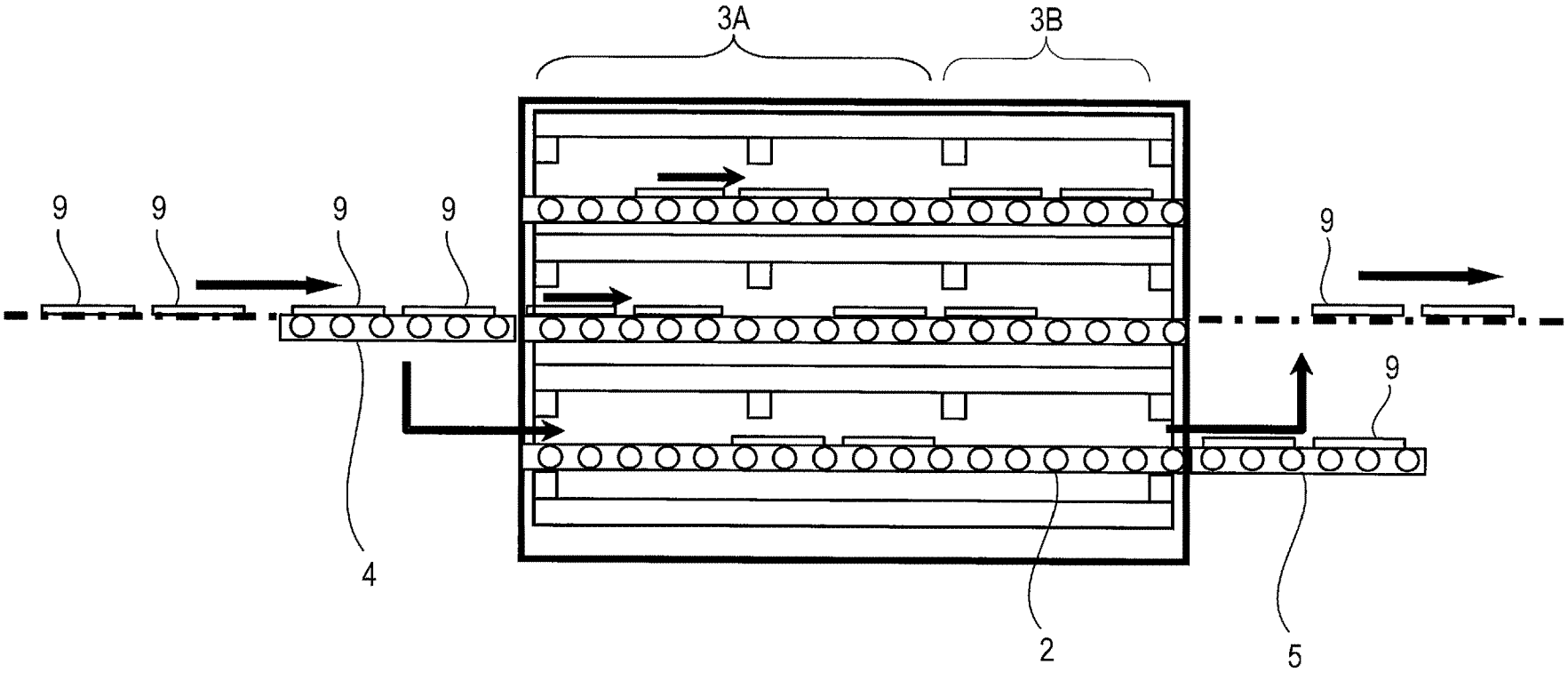
FIG. 4 is a diagram showing a configuration of a heating device of a modified example.

[B3] For example, as shown in FIG. 4, the continuous furnace with multiple stages (in this example, three stages) (a structure in which continuous-type heating furnaces are provided in multiple stages) may be used. With such a configuration, in a high-speed production line, a length of a furnace can be reduced depending on a number of stages. Moreover, since the furnace has the multi-stage and continuous structure, a height thereof can be reduced. Specifically, for example, it may be configured such that: an elevator-type carrying-in device 4 is directly connected to the continuous furnace and carries the metal plate 9 from a destacker, into the continuous furnace; an elevator-type carrying-out device 5 is directly connected to the continuous furnace and carries the metal plate 9 from the continuous furnace, to a pressing apparatus side; the carrying-in device 4 and the carrying-out device 5 are movable upwardly and downwardly; and one (common) set of the carrying-in device 4 and the carrying-out device 5 is used for multiple continuous furnaces. Here, the dashed-and-dotted lines indicate conveying levels after and before the continuous path.

[B4] The infrared heater 3 may be disposed on locations other than the ceiling surface (for example, below or side, etc. of the conveyance path), instead of or in addition to the ceiling surface of the conveyance path.

[B5] Elements of the present invention are conceptual, and should not be limited to those in the above-described embodiment. For example, functions that one element has may be divided among a plurality of elements, or functions that a plurality of elements have may be integrated to one element. Moreover, at least part of the configuration of the above-described embodiment may be replaced with a known configuration having the same function.

The invention claimed is:

1. A method for heating a plated metallic material having an Ac3 point using a heating device that includes a continuous furnace comprising a first infrared heater stage and a second infrared heater stage, wherein the second infrared heater stage is arranged downstream from the first infrared heater stage in a conveyance path for the plated metallic material, the method comprising:

conveying the plated metallic material into the continuous furnace; and heating the plated metallic material in the continuous furnace, wherein the plated metallic material is conveyed from the first infrared heater stage to the second infrared heater stage in the continuous furnace, wherein the plated metallic material is heated in the first infrared heater stage at an first temperature, and wherein the plated metallic material is heated in the second infrared heater stage at a second temperature that is less than the first temperature, such that a temperature of the plated metallic material becomes equal to or higher than the Ac3 point and less than a boiling point of plating of the plated metallic material.

2. The method of claim 1, wherein a staying time of the plated metallic material in the first infrared heater stage is longer than a staying time of the plated metallic material in the second infrared heater stage.

3. The method of claim 1, wherein a temperature of the first infrared heater stage is higher than a temperature of the second infrared heater stage.

4. The method of claim 1, wherein a conveyance path of the plated metallic material through the second infrared heater stage is longer than a conveyance path of the plated metallic material through the first infrared heater stage.

5. The method of claim 1, wherein the plated metallic material is conveyed from the first infrared heater stage to the second infrared heater stage during an increase in temperature of the plated metallic material.

6. The method of claim 1, wherein the plated metallic material is conveyed from the first infrared heater stage to the second infrared heater stage during an increase in temperature of the plated metallic material to the boiling point of plating of the plated metallic material.

7. The method of claim 1, wherein the plated metallic material is conveyed through the first infrared heater stage and the second infrared heater stage at a constant speed.

8. The method of claim 1, wherein an entirety of the plated metallic material is heated in the first infrared heater stage before the plated metallic material is conveyed to the second infrared heater stage.

9. The method of claim 1, wherein the first infrared heater stage causes a more rapid increase in temperature of the plated metallic material than the second infrared heater stage.

* * * * *